US005600932A

United States Patent [19]

Paik et al.

[11] Patent Number: 5,600,932

[45] Date of Patent: Feb. 11, 1997

[54] BEAM WITH ENHANCED BEARING LOAD STRENGTH AND METHOD OF MANUFACTURE

[76] Inventors: Young J. Paik; David S. Paik; Nelson S. Paik, all of 19826 S. Alameda St., Rancho Dominguez, Calif. 90221

[21] Appl. No.: 583,338

[22] Filed: Jan. 5, 1996

[51] Int. Cl.[6] ..... E04C 3/07

[52] U.S. Cl. ..... 52/745.19; 52/729.1; 52/729.2; 52/729.3; 52/730.6; 52/737.6; 29/897.3; 29/897.35; 29/401.1

[58] Field of Search ..... 52/729.3, 729.2, 52/729.1, 737.6, 745.19, 730.6; 29/897.35, 897.33, 897.3, DIG. 42, 401.1

[56] References Cited

U.S. PATENT DOCUMENTS

| | | | |
|---|---|---|---|
| 101,015 | 3/1870 | Holms | 52/729.3 |
| 183,160 | 10/1876 | Haughian | 52/729.2 X |
| 2,065,493 | 12/1936 | Greulich | 29/897.35 X |
| 4,047,354 | 9/1977 | Sutherland | 29/897.35 X |
| 4,251,973 | 2/1981 | Paik | 52/729.3 |
| 4,597,278 | 7/1986 | Hamada et al. | 52/729.3 X |

*Primary Examiner*—Christopher Todd Kent
*Attorney, Agent, or Firm*—George J. Netter

[57] ABSTRACT

A first stage structural support beam (22,50) with flanges (12,14; 52,54) separated by an integral web (16) has the web stretched to increase the web height by a value Δ following which a set of corrugations (34,48,62) is formed into the web. The resulting beam (38,40,50) has substantially increased weight-to-load characteristics as compared to the first stage beam.

10 Claims, 3 Drawing Sheets

BEAM WITH ENHANCED BEARING LOAD STRENGTH AND METHOD OF MANUFACTURE

BACKGROUND

1. Background of the Invention

The present invention relates generally to an I-beam or channel construction and, more particularly, to such an I-beam or channel having a web of reduced cross-sectional dimensions and enhanced strength, and a method of making the same.

2. Description of Related Art

I-beams or channel beams are well known especially in the building industry for providing the basic support of the entire structure, which beams include first and second relatively flat flanges held separated and generally parallel to one another by an intervening wall member connecting the two flanges, the latter most frequently referred to as a "web". To enhance ultimate use and to reduce manufacturing costs, it is desirable to be able to produce such beams which are optimally light-weight for a given bearing strength. Typically, a beam can be made lighter by merely reducing the web thickness, however, if nothing else is done the bearing strength of the beam will be reduced which in the extreme could cause the beam to buckle or collapse during use.

In U.S. Pat. No. 4,251,973 there is provided an I-beam or channel having a central region of the web deformed into a set of corrugations which extend along the beam length. This patented construction substantially increases the strength of the beam beyond that which would typically be achieved by merely leaving the web in its normal flat condition. Accordingly, this offers the ability to reduce the beam weight from more conventional designs and yet not sacrifice beam bearing load capabilities. Although the referenced patent provides a substantially superior beam for bearing strength from that which can be produced using an unmodified web of uniform thickness, it is desirable to be able to reduce beam weight even further without decreasing beam strength, or even to increase beam strength.

SUMMARY OF THE PRESENT INVENTION

In accordance with the present invention, an I-beam or channel beam is provided having a pair of flanges which are separated by an initially stretch-tapered web having a minimal thickness at substantially the center line, for example, between the two flanges and with a set of corrugations generally centered along the minimum thickness portion of the web. Stretching to achieve a tapered web also increases the flange spacing which increases beam strength and the addition of corrugations further increases the web strength (i.e., resistance against collapsing) thereby achieving a considerably lighter and strengthened beam as compared to a beam of the same overall size made in known conventional manner.

The method of producing the beam of this invention is to form a first stage beam (or channel) having a pair of parallel flanges separated by a substantially uniform thickness web. Then, preferably as part of an in-line process, the first stage beam is passed through a set of forming rollers which causes the flanges to be increased in their spatial relation to one another stretching the web to produce a tapering effect from each flange such that there is a minimum thickness point along substantially the center line of the web, for example. The final step includes passing the stretched second stage beam through special forming rollers which maintain the flanges at a constant spatial relation while applying corrugations along a central region of the web. This method may be advantageously applied to a first stage beam made either by roll forming or welding flanges to an intervening web ("welded beam").

BRIEF DESCRIPTION OF THE DRAWING

These and other objects and advantages of the present invention will become more readily apparent upon reading the following detailed description and upon reference to the attached drawings in which.

DESCRIPTION OF A PREFERRED EMBODIMENT

Although the invention can be advantageously employed in the manufacture of I-beams and channels of great variety, it will be initially described in connection with a hot-rolled beam.

Figure 1:
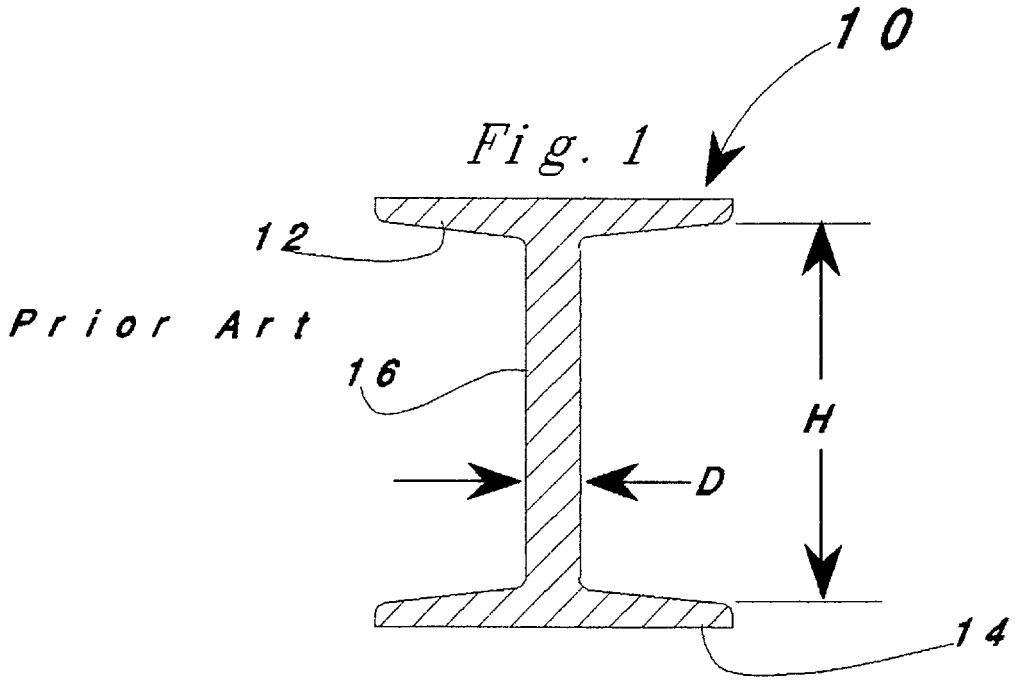
Fig. 1 Prior Art
FIG. 1 is an end elevational view of a prior art I-beam.

With reference now to the drawings and particularly FIG. 1, there is shown a conventional I-beam 10 which is manufactured by passing a billet (not shown) through forming rollers to provide a pair of parallel flanges 12 and 14 separated by a substantially uniformly thick web 16. This beam is a typical prior art construction and its strength (i.e., bearing strength) is a function of the material from which it is made and its geometric construction. That is, where the material is a constant (e.g., steel), the web thickness D and height of the web H primarily determines the bearing strength of the beam. For a given component metal, the thicker D is the stronger the web is, and thus the beam. Also, it can be shown that increasing H also increases overall beam strength.

In the referenced U.S. Pat. No. 4,251,973 shown in FIG. 2, a welded beam 18 similar to that shown in FIG. 1, further includes a set of corrugations 20 extending lengthwise of the web which increase the bearing strength of the beam over what it would normally be if a uniformly thick web were employed. By use of the patented technique, the beam may be lightened from that of the FIG. 1 category, while at the same time achieve the same overall load bearing strength, or even increase the strength.

Figure 3A:
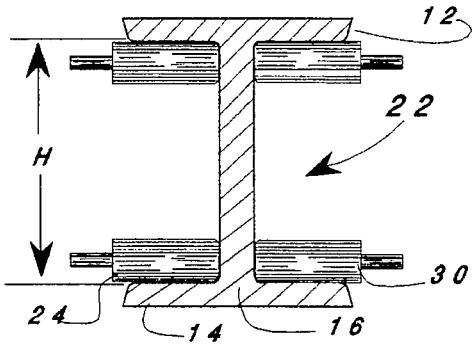
FIGS. 3A, 3B and 3C are schematic depictions of stages in the formation of an I-beam of the present invention.

For the ensuing detailed description of the method for producing the I-beam of this invention, reference is now made particularly to FIGS. 3A, B and C depicting the various stages in manufacture. In FIG. 3A, an interim or first stage beam identified generally as 22 is produced by forming rolls 24 (shown schematically) in a conventional manner and which beam can be identical to the prior art beam 10 shown in FIG. 1. Accordingly, in FIG. 3A the same dimensions and numerals of FIG. 1 are used for the corresponding parts. Although the first stage beam can be made of any desirable size, it is being described here as starting with an identical size to that of the prior art beam in order to use that beam as a basis for comparing the relative strength of a beam of this invention.

Figure 3B:
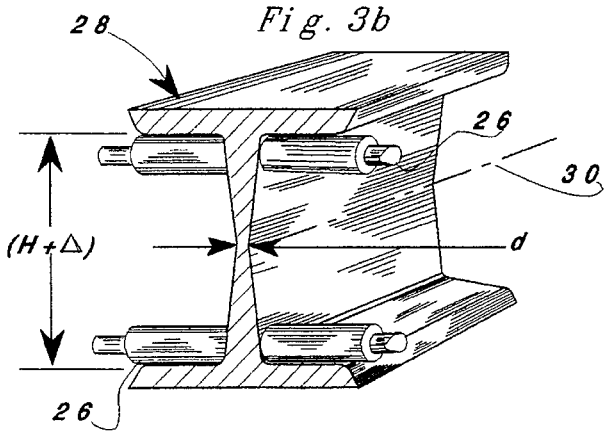

The second phase in the production of the described beam is depicted in FIG. 3B where the first stage beam 22 is moved between forming rolls 26 in order to achieve a second stage beam 28 having a web stretched from the original dimension H an increased value to (H+Δ) which can be any convenient amount sufficient to cause the web to thin down to a lesser cross-sectional dimension d preferably at or close to the center line 30 of the web with adjacent portions of the web tapering from each flange in a generally uniform manner. Accordingly, the thickest part of the web will be that part immediately adjacent each flange and will be substantially unchanged from that which is to be found in the prior art beam 10 or in the patented beam.

Figure 3C:
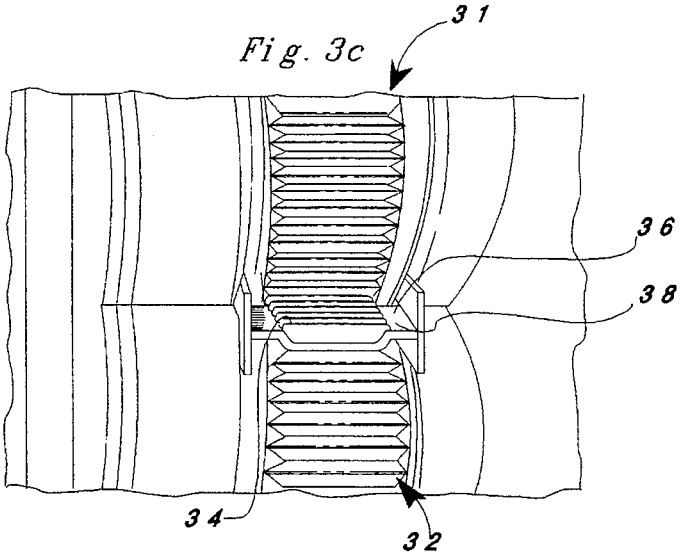

The second stage stretched beam 28 is then moved between a set of corrugating members 31 and 32 in order to form a strip of corrugations 34 substantially centered along the minimal thickness part of the web (FIG. 3*c*). It is preferable that the corrugations do not extend all the way to either flange but rather are spaced slightly from each flange leaving an uncorrugated strip 36 immediately adjacent each flange.

The resulting final beam 38 is the beam of the present invention and it will be noted first of all that it has an increased web height dimension (H+Δ) and, therefore, has greater bearing strength than the prior art beam 10. Also, the addition of corrugations provides even more structural strength to the beam.

Figure 2:
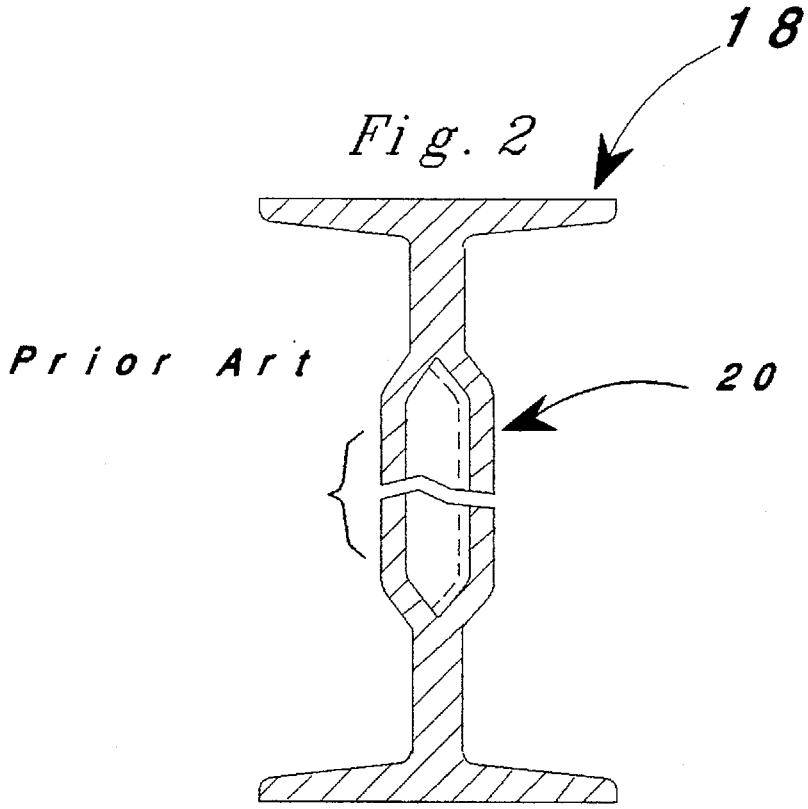
Fig. 2 Prior Art
FIG. 2 is a perspective view of a further prior art I-beam.

In summary, the present invention provides a beam 38 which has greater strength than either the prior art beam of FIG. 1 or the patented beam of FIG. 2 while not requiring more component material, and therefore has a lower weight/strength ratio than either of these prior beams.

Figure 4:
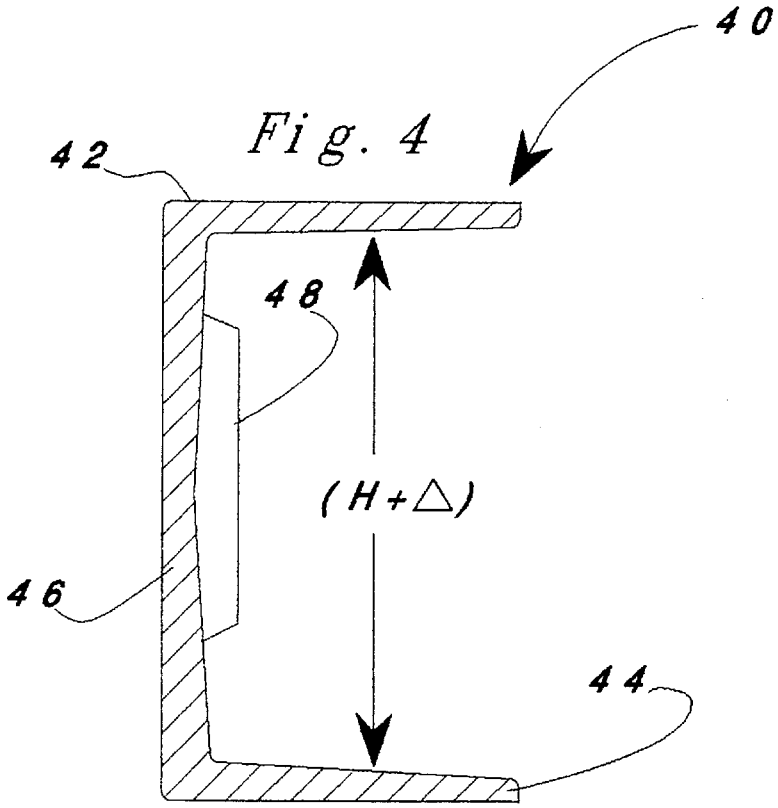
FIG. 4 depicts an end view of a channel constructed in accordance with the invention.

Although the invention has been described in connection with the making of an I-beam, it is also equally applicable to making a channel 40 as shown in FIG. 4, for example, in which the flanges 42 and 44 of the channel are separated by a web 46 which has been stretched in the manner described to (H+Δ) and then provided with corrugations 48 along the minimal thickness part of the web. For the reasons already given in regard to the I-beam construction, this channel is also stronger and lighter than one of the same outline dimensions made in accordance with known techniques.

Figure 5:
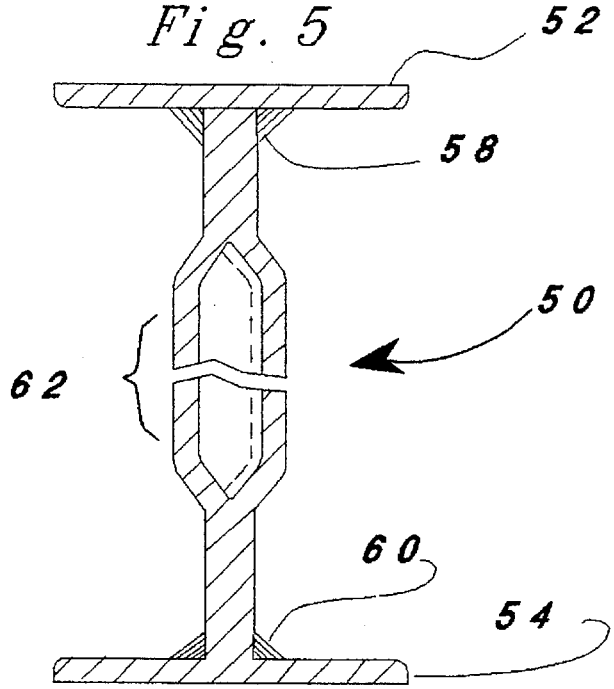
FIG. 5 is a depiction of a welded beam constructed in accordance with the present invention.

FIG. 5 shows application of the invention to enhancing bearing strength of a beam 50 which in its first stage form includes a pair of flanges 52 and 54 welded to opposite edges of an intervening web 56 via weldments 58 and 60 forming a so-called welded beam as referenced in U.S. Pat. No. 4,251,973. Then, as previously described, the first stage is stretched following which a set of corrugations 62 are formed in the web.

Although the invention has been described in connection with preferred embodiments, it is to be understood that those skilled in the appertaining arts may contemplate changes that come within the spirit of the described invention and within the ambit of the appended claims.

What is claimed is:

1. A method of making a support beam, comprising:

forming a first stage beam having first and second flanges unitarily connected to an intervening web having a central portion of substantially uniform thickness;

stretching the web central portion of the first stage beam in a direction to increase the distance between the flanges and simultaneously to taper the web thickness from each flange to an intermediate minimum thickness region; and corrugating the web intermediate the flanges including the intermediate thickness region.

2. A method as in claim 1, in which the forming includes the steps of heating a metal billet to malleability and roller pressing the heated billet.

3. A method as in claim 2, in which the first stage beam is stretched by forming rollers.

4. A method as in claim 1, in which forming includes the step of welding first and second flanges to an intervening web.

5. A method of making a beam having first and second flanges separated by an interconnecting web from a billet, comprising the steps of:

passing the billet through a first set of forming rollers to provide a first stage beam having first and second flanges separated by a web of substantially uniform thickness D and height H;

passing the first stage beam through a second set of forming rollers to stretch the web height a predetermined amount into a second stage beam having a tapered web thickness with a continuous web minimum thickness portion lying intermediate the flanges; and corrugating a section of the web including the minimum thickness portion.

6. A method as in claim 5, in which the forming and corrugating operations are conducted with the billet first and second stages being heated to malleable condition.

7. A method as in claim 5, in which the first stage is formed from a billet heated to malleability; and second stage formation and corrugating are conducted on a workpiece having a temperature less than that at which the workpiece is malleable.

8. A method of increasing the strength of a preformed beam having first and second flanges interconnected by a generally uniform thickness web and simultaneously reducing the beam weight-to-bearing strength ratio, comprising the steps of:

stretching the beam web to separate the flanges a predetermined further amount and provide a minimal thickness region extending longitudinally of the web; and forming a set of corrugations along the minimal thickness web portion.

9. A method as in claim 8, in which the corrugation forming includes repeated local deforming of the web to extend outwardly away from the web on at least one major surface.

10. A method of making a support beam, comprising:

forming a first stage beam having first and second flanges unitarily connected to an intervening web having a greater thickness immediately adjacent each flange than elsewhere;

stretching the web central portion of the first stage beam in a direction to increase the distance between the flanges and simultaneously to taper the web thickness from each flange to an intermediate minimum thickness region; and corrugating the web intermediate the flanges including the intermediate thickness region.

* * * * *